United States Patent [19]

Bruhn et al.

[11] Patent Number: 4,729,685

[45] Date of Patent: Mar. 8, 1988

[54] WRITING INSTRUMENT WITH PRESS MECHANISM AND MAGNETIC CATCH

[75] Inventors: Bernhard Bruhn, Halstenbek; Jose Navarro-Ramil; Reiner Segebarth, both of Hamburg, all of Fed. Rep. of Germany

[73] Assignee: Koh-I-Noor Rapidograph, Inc., Bloomsbury, N.J.

[21] Appl. No.: 77,346

[22] Filed: Jul. 24, 1987

[30] Foreign Application Priority Data

Jul. 26, 1986 [DE] Fed. Rep. of Germany ..... 3625381

[51] Int. Cl.[4] ..... B43K 24/02; B43K 24/08

[52] U.S. Cl. ..... 401/100; 401/108; 401/112; 401/115

[58] Field of Search ..... 401/100, 109, 112, 113, 401/114, 108, 115

[56] References Cited

U.S. PATENT DOCUMENTS

| | | | |
|---|---|---|---|
| 2,757,639 | 8/1955 | Wichmann . | |
| 2,870,741 | 1/1959 | Kersten | 401/100 |
| 2,933,067 | 4/1960 | Larson | 401/113 |
| 4,176,979 | 12/1979 | Saida . | |
| 4,352,580 | 10/1982 | Ando . | |
| 4,377,349 | 3/1983 | Kunii . | |

FOREIGN PATENT DOCUMENTS

| | | | |
|---|---|---|---|
| 1294850 | 5/1969 | Fed. Rep. of Germany . | |
| 1298911 | 7/1969 | Fed. Rep. of Germany . | |
| 216433 | 10/1967 | Sweden | 401/112 |

*Primary Examiner*—Steven A. Bratlie

*Attorney, Agent, or Firm*—David H. Semmes; Warren E. Olsen

[57] ABSTRACT

In a writing instrument with a pressure mechanism for the movement of a writing element (4, 5, 6, 11, 12, 13) against spring pressure from a retracted position of rest into an advanced writing position, in which retention by means of a retention element (18, 19, 20) takes place, the retention element (18, 19, 20) has a cup section (18) open towards the rear. In this cup section is a ball (23) of magnetizable material which is axially freely movable back and forth in the cup section. Adjacent to the opening of the cup section (18) is a permanent magnet (16), the front face of which forms a concave contact surface (17), disposed coaxially to the writing element (4, 5, 6, 11, 12, 13) for the placement of the ball (23).

20 Claims, 5 Drawing Figures

WRITING INSTRUMENT WITH PRESS MECHANISM AND MAGNETIC CATCH

BACKGROUND OF THE INVENTION

1. Field of the Invention

The invention relates to a writing instrument having a pressure mechanism that moves a writing element from a retracted position of rest into an advanced writing position, in which the writing element is retained against the writing pressure. From the advanced position the mechanism returns to the position of rest by means of spring pressure and displacement of a retention element, out of an engagement position with the instrument housing.

2. Brief Description of the Prior Art

In a known writing instrument of this type (DE-AS No. 1 294 850) the rear end of the writing element, which is in the form of a ball point refill, extends into a blind bore of a retention element on which the clip of the writing instrument is formed. The retention element has a lateral protrusion extending into an opening of the instrument housing, so that it retains the writing instrument in the writing position by means of interaction of its rear surface with the rear end of the opening. The position of rest of the writing instrument is defined by interaction of a surface located further forward with the rear end of the opening, thus preventing backward movement of the retention element and writing element out of the instrument housing. The writing and retention elements are under a rearward-acting spring pressure so they are pushed backward into the position of rest by a tilting of the clip when the protrusion is freed from the retaining engagement position with the opening.

Thus, in this known writing instrument the user can move the writing element between a forwardly displaced writing position and a retracted position of rest, as well as from the position of rest into the writing position by the respective displacement by hand of a retention element.

SUMMARY OF THE INVENTION

In contrast thereto, it is an object of the present invention to provide a writing instrument in which, although the writing element is moved by hand from the position of rest to the writing position, the displacement from the writing position into the position of rest occurs automatically when the writing instrument is put down on a generally horizontal surface.

To attain this object, a writing instrument of the species mentioned above is embodied by a retention element provided with a cup section open to the rear, the axial length of which is larger than its inside diameter, and into which has been inserted a ball of a magnetizable material, freely axially movable. Adjacent to the opening of the cup section a permanent magnet is disposed, the surface of the magnet adjacent to the cup section having a concave surface disposed coaxially to the writing element. The retaining force exerted by the permanent magnet on the ball is less than the weight of the ball.

Thus, a specially formed retention element is provided in the writing instrument according to the invention which operates by cooperation with the permanent magnet, i.e., with the contact surface of the permanent magnet and a magnetizable ball. To move the writing instrument from the position of rest into the writing position, the retention element is displaced in the usual manner such that the writing element moves forward into the writing position and the retention element assumes a retaining engagement position with the instrument housing. Since this normally takes place in a generally vertical position, and since the retaining force exerted by the permanent magnet on the ball is less than the weight of the ball, the ball drops away from the permanent magnet and rests on the bottom of the cup section of the retention element. When the writing instrument is placed on a generally horizontal surface, however, the ball is pulled against the contact surface of the permanent magnet, thus displacing the cup section such that the retention element is moved out of its engagement position with the instrument housing. Because of the spring pressure, the writing element returns into its position of rest.

It is also already known (DE-AS No. 1 298 911) to utilize a permanent magnet and a ball of magnetizable material attracted to it in the pressure mechanism of a writing instrument. However, the elements of that prior reference serve only to facilitate the manual displacement of the writing element into the writing and rest positions, in contrast to the present invention which provides for the automatic return of the writing element from the writing position to the position of rest.

In a writing instrument according to the present invention, the opening of the cup section preferably is eccentrically disposed with respect to the contact surface of the permanent magnet, when the retention element is in the engagement position. The permanent magnet can extend into the cup section when the writing element is in the position of rest.

In this embodiment the diameter of the ball is only slightly less than the inside diameter of the cup section, so the ball is allowed to change the orientation of the cup section with respect to the permanent maget. Thus, when the pen is placed on a horizontal surface, reorientation of the cup section occurs, and the retention element is freed from its engagement position with the instrument housing. The position of the cup section during the position of rest of the writing element is securely maintained by the extension of the permanent magnet into the cup section.

In this embodiment the cup section can be pivotable around a point on the longitudinal axis of the writing instrument, between the eccentric position of its opening in relation to the contact surface of the permanent magnet and the position in which the permanent magnet extends into the cup section. The displacement movement of the cup section can be attained by a very simple construction.

To maintain the cup section in a defined position with respect to the writing element, a guide section on the cup section which extends into the connecting area with the writing element may be provided to prevent lateral movements of the bottom area of the cup section in relation to the writing element.

To make possible a simple activation of the pressure mechanism in this construction, an externally accessible button section of the retention element may be disposed axially movable in an opening of the clip, such as is known per se in other writing instruments.

In this construction a rear surface of the button section of the retention element can be in retaining contact with a protrusion on the instrument housing in the engaging position.

With technical or stylus writing instruments of tubular construction there is generally the problem of the writing tube drying out quickly, if it is laid aside for a short period of time after use and the closing cap is not screwed on.

If a tubular writing instrument of the above described type is constructed according to the invention, it is practical to provide at the front end of the instrument housing a first sealing element which closes the front end of the tubular writing instrument in the position of rest of the writing element and through which will extend the writing tube, in the writing position for the writing element.

By means of this construction a positive sealing of the front end of the writing tube occurs because of the automatic movement of the writing element into the position of rest when laid down.

The invention is described in detail by means of the drawings illustrating a preferred embodiment.

DETAILED DESCRIPTION OF THE PREFERRED EMBODIMENT

Figure 1:
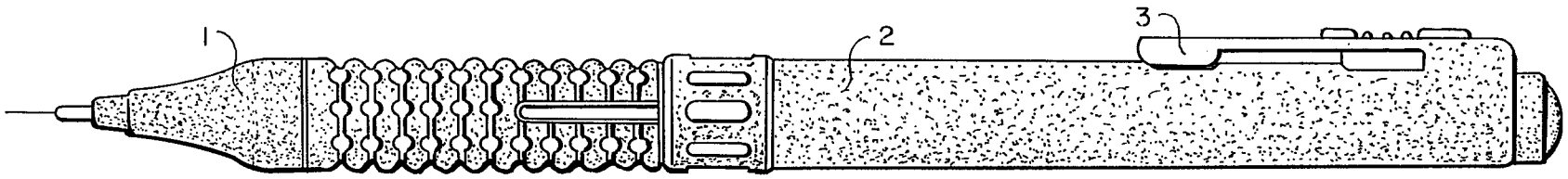
FIG. 1 is a side view of a writing instrument in the form of a tubular writing instrument.

The writing instrument shown has a front housing part 1 and a rear housing part 2 which are screwed together in the customary way. A clip 3 is fastened to the rear housing part 2, and a closure cap 14 is irremovably inserted into the rear end of the housing part 2 and supports a button 15 which can be used, for example, for color coding.

Inside the housing is a schematically shown tip of a tubular writing instrument having a cylindrical body 5, a writing tube 6 inserted into its front end and a covering sleeve 4 screwed onto the cylindrical body covering the compensating chamber formed on its outer surface, which is connected with the ambient air on its front. An ink cartridge 11 is pushed in the usual manner into the rear part of the cylindrical body. A further ink cartridge 12 is contained in the instrument housing and contacts with its front end the ink cartridge 11 and with its rear end, the connecting end 13 for the cylindrical body.

A retention element is inserted into the rear end of the housing part 2, having a cup section 18 open to the rear and a guide section 19 abutting thereon and extending forward. The bottom of the cup section 18 which is somewhat pointed abuts on the end face of the connecting end 13 of the cartridge 12 and the guide section 19 surrounds this connecting end. The button section 20 is formed on the side of the cup section 18, extending through a lateral opening in the housing part 2 as well as through an opening 22 in the clip 3, and is thus accessible from the outside.

A permanent magnet 16 is fixedly disposed coaxially with respect to the longitudinal axis 25 of the point of the tubular writing instrument housing in the closure cap 14. Its front face 17 is concavely curved and formed circle-symmetrically in relation to the longitudinal axis 25. The curvature of the contact surface 17 of the permanent magnet 16 corresponds to the surface curvature of a ball 23 of magnetizable material, preferably of ferromagnetic material, which is disposed in the cup section 18. As shown, the diameter of the ball 23 is clearly less than the length of the cup section 18 and also slightly less than the inside diameter of the cup section 18, so that the ball 23 is freely movable back and forth in the section 18, but has little lateral play.

Figure 2:
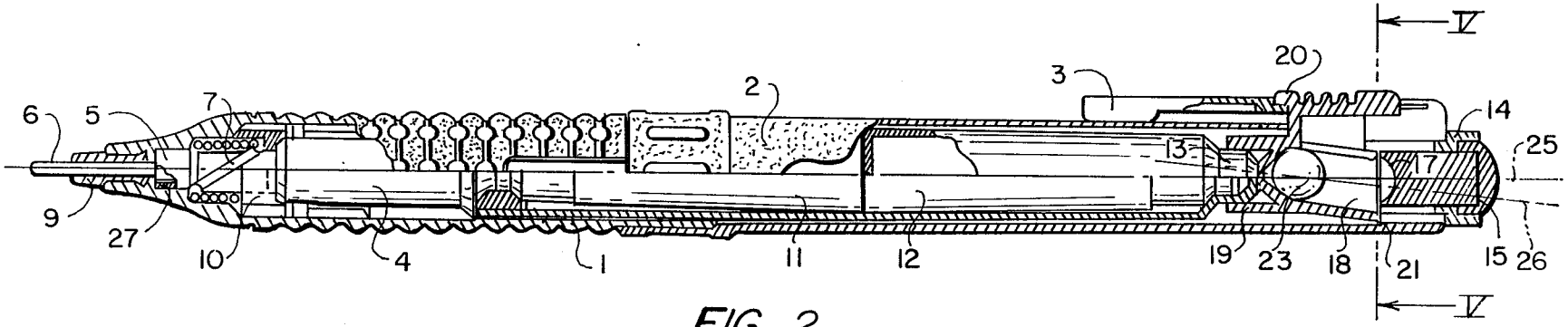
FIG. 2 is a partial view and a partial section of the writing instrument of FIG. 1, the tip of the tubular writing instrument being in the writing position.
Figure 3:
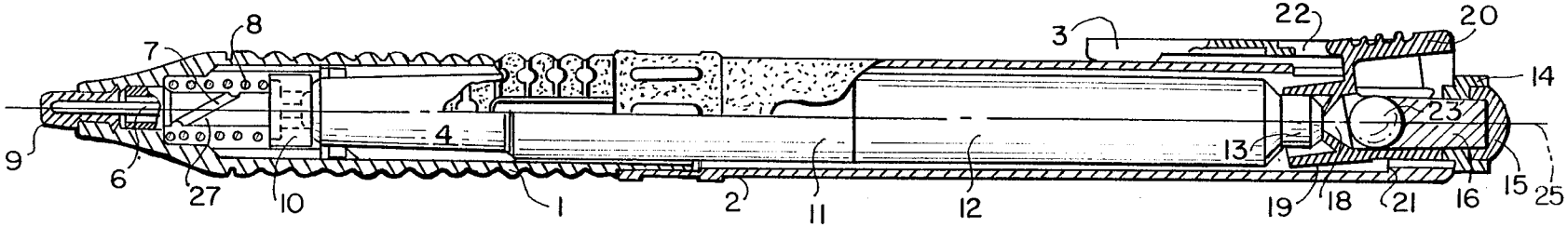
FIG. 3 shows the writing instrument corresponding to FIG. 2 with the tip of the tubular writing instrument being in a position of rest.

A seal 9 of an elastic material is provided in the front end of the housing part 1 through which extends the writing tube 6 in the writing position of the tubular writing instrument, as shown in FIG. 2, so that its front end can be brought into contact with a drawing surface. The front end of the writing tube 6 is closed by the seal 9 in the position of rest (FIG. 3).

Furthermore, a non-rotatable guide bushing 27, which includes a spiral groove 7, is disposed on the front section of the cylindrical body 5 and is connected with the housing part 1. An annular seal 10 is rotatably placed on the guide bushing 27, and is pressed rearward against the sleeve 4. The sleeve 4 is screwed on the cylinder body by a spring 8, the front end of which is supported against an annular shoulder in the housing part 1. In this manner a constant rearward-acting spring pressure is exerted on the tip of the tubular writing instrument.

The seal 10 is connected with the groove 7 by means of a protrusion formed in the seal. In the writing position (FIG. 2) the seal 10 connects the compensating chamber to be sealed.

In the position indicated in FIG. 2, the tubular writing instrument is in the writing position. The cup element 18 of the detention element is tilted in relation to the longitudinal axis 25 of the tip of the tubular writing instrument, so that its longitudinal axis 26 extends inclined to the axis 25. Because of this tilted position, the outer area of the button section 20 lies in a plane parallel to the outer area of the clip 3, and the rear end of the button section 20 is in engagement with a protrusion 21 (FIG. 3) formed in the closure cap 14. It is maintained in this engagement position by the pressure of the spring 8. Since the tubular writing instrument is in a generally vertical attitude in the writing position, the ball 23 lies in the bottom of the cup section 18, as indicated in FIG. 2.

If the writing instrument is laid down from a position of rest onto a generally horizontal surface, the ball 23 in the cup section 18 rolls in the direction towards the permanent magnet 16 and is attracted by it. As the ball 23 comes to rest against the concave contact surface 17 of the permanent magnet 16, it causes a lateral displacement of the opening area of the cup section 18, which subsequently leads to a pivoting of the retention element around the contact surface on the end face of the connecting end 13 of the ink cartridge 12. Because of this pivoting, the rear end of the button section 20 is pressed outwardly and freed from engagement with the protrusion 21 so that the tip of the tubular writing instrument, together with the ink cartridges 11 and 12, are backwardly displaced as a result of the pressure of the spring 7. As can be seen in FIG. 3, the cup section 18 is displaced rearwardly such that the permanent magnet 16 extends into the cup section 18, and prevents lateral pivoting of the retention element. Therefore the action of the guide section 19, which in other positions prevents lateral displacement of the bottom part of the cup section 18, is not required in this position.

Figure 5:
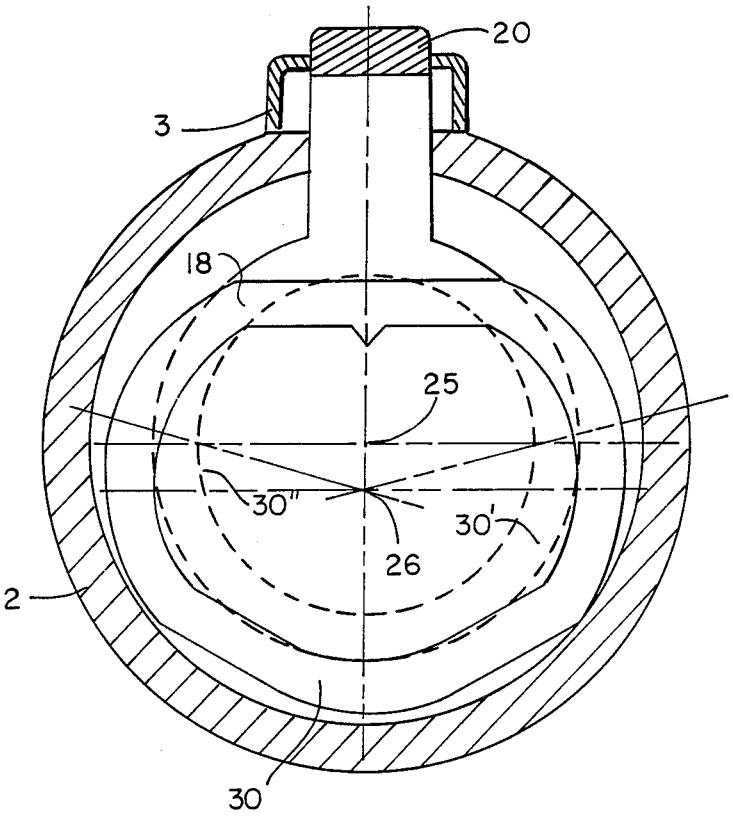
FIG. 5 is a cross section along the line V—V.

As can be seen in FIG. 5, the inner surface of the cup element has been provided with three guide sections 30, 30', 30'' in the shape of longitudinally extending grooves. These grooves guarantee that the ball 23 can roll perfectly, even in a position where the clip is located on the side.

To return the tip of the tubular writing instrument into the writing position, the writing instrument is moved into a generally vertical attitude and the button section 20 is then pushed forward. The entire retention element, as well as the tip of the tubular writing instrument, then moved forward and, because the weight of the ball 23 is greater than the retention power of the permanent magnet 16, the ball 23 is freed from the contact surface 17 and falls into the bottom of the cup section 18. In this advanced attitude the opening area of the cup section 18 is also free of the permanent magnet 16, and the rear end of the button section 20 can be pivoted inwardly and thus brought into engagement with the protrusion 21 in order to retain the top of the tubular writing instrument in the writing position.

Figure 4:
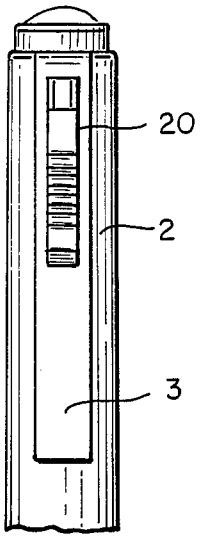
FIG. 4 is a top view of the clip and the upper part of the housing.

FIG. 4 is a top view of the clip 3 which is connected with the housing part 2 and serves as guide for the button section 20.

It is to be understood that the above description of an exemplary emodiment has been given only by way of example and that further variations and improvements are possible within the scope of the invention, as defined by the appended claims.

We claim:

1. A writing instrument with a pressure mechanism for the movement against a spring pressure of a writing element (4, 5, 6, 11, 12, 13) from a retracted position of rest into an advanced writing position, in which the writing element (4, 5, 6, 11, 12, 13) is retained against the writing pressure and from which it can be returned into the position of rest by means of spring pressure by the displacement of a retention element (18, 19, 20) out of an engagement position with an instrument housing (1, 2, 14, 15), wherein the retention element (18, 19, 20) has a cup section (18) open towards the rear, the axial length of which is greater than its inner diameter and into which has been inserted a ball (23) of a magnetizable material which is axially freely movable back and forth, and wherein a permanent magnet (16) is disposed adjacent to the opening of the cup section (18), the surface of which oriented towards the cup section (18) has a concave contact surface (17) disposed coaxially to the writing element for the ball (23), and in that the retention power exerted by the permanent magnet (16) on the ball (23) resting against it is less than the weight of the ball (23).

2. A writing instrument in accordance with claim 1, wherein the opening of the cup section (18) in the engagement postion of the retention element (18, 19, 20) is eccentrically disposed with respect to the contact surface (17) of the permanent magnet (16), and wherein the permanent magnet (16) extends into the cup section (18) in the position of rest of the writing element (4, 5, 6).

3. A writing instrument in accordance with claim 2, wherein the cup section (18) is pivotable around a point on the longitudinal axis (25) of the writing element (4, 5, 6, 11, 12, 13) between the eccentric position of its opening with respect to the contact surface (17) of the permanent magnet (16) and the position where the permanent magnet (16) extends into the cup section (18).

4. A writing instrument in accordance with claim 3, wherein a guide section (19) provided in the cup section (18) extends across the connecting end (13) with the writing element (4, 5, 6, 11, 12, 13).

5. A writing instrument in accordance with claim 1, wherein an externally accessible button section (20) of the retention element (18, 19, 20) is guided axially movable in an opening (22) of the clip (3).

6. A writing instrument in accordance with claim 5, wherein a rear surface of the button section (20) of the retention element (18, 19, 20) is in retaining engagement with a protrusion (21) in the instrument housing (1, 2, 14, 15) when the instrument is in the engagement position.

7. A writing instrument in accordance with claim 1, further comprising a tubular writing instrument, wherein a sealing element (9) provided in the front end of the instrument housing (1, 2, 14, 15) sealingly closes the front end of the writing tube (6) in the position of rest of the writing element (4, 5, 6, 11, 12, 13) and through which extends the writing tube (6) in the writing position of the writing element (4, 5, 6, 11, 12, 13).

8. A writing instrument in accordance with claim 2 further comprising a tubular writing instrument, wherein a sealing element (9) provided in the front end of the instrument housing (1, 2, 14, 15) sealingly closes the front end of the writing tube (6) in the position of rest of the writing element (4, 5, 6, 11, 12, 13) and through which extends the writing tube (6) in the writing position of the writing element (4, 5, 6, 11, 12, 13).

9. A writing instrument in accordance with claim 3 further comprising a tubular writing instrument, wherein a sealing element (9) provided in the front end of the instrument housing (1, 2, 14, 15) sealingly closes the front end of the writing tube (6) in the position of rest of the writing element (4, 5, 6, 11, 12, 13) and through which extends the writing tube (6) in the writing position of the writing element (4, 5, 6, 11, 12, 13).

10. A writing instrument in accordance with claim 4 further comprising a tubular writing instrument, wherein a sealing element (9) provided in the front end of the instrument housing (1, 2, 14, 15) sealingly closes the front end of the writing tube (6) in the position of rest of the writing element (4, 5, 6, 11, 12, 13) and through which extends the writing tube (6) in the writing position of the writing element (4, 5, 6, 11, 12, 13).

11. A writing instrument in accordance with claim 5 further comprising a tubular writing instrument, wherein a sealing element (9) provided in the front end of the instrument housing (1, 2, 14, 15) sealingly closes the front end of the writing tube (6) in the position of rest of the writing element (4, 5, 6, 11, 12, 13) and through which extends the writing tube (6) in the writing position of the writing element (4, 5, 6, 11, 12, 13).

12. A writing instrument in accordance with claim 6 further comprising a tubular writing instrument, wherein a sealing element (9) provided in the front end of the instrument housing (1, 2, 14, 15) sealingly closes the front end of the writing tube (6) in the position of rest of the writing element (4, 5, 6, 11, 12, 13) and through which extends the writing tube (6) in the writing position of the writing element (4, 5, 6, 11, 12, 13).

13. A writing instrument in accordance with claim 7, wherein a second annular sealing element (10) is disposed on the writing element (4, 5, 6, 11, 12, 13) ahead of the connecting opening(s) of the compensating chamber with the ambient air, pushed by a spring (8) in the direction of the connecting opening(s), wherein the second sealing element (10) in the writing position of the writing element (4, 5, 6, 11, 12, 13) is aligned with recess provided therein and thus unblocks the connecting opening(s), and in the position of rest of the writing element (4, 5, 6, 11, 12, 13) closes the connecting opening(s).

14. A writing instrument in accordance with claim 13, wherein the second sealing element (10) is guided for turning in a spiral groove (7) of a nonrotatable guide bushing (27).

15. A writing instrument in accordance with one of claim 1 further comprising a tubular writing instrument, wherein grooves (30, 30′, 30″) extending in the longitudinal axis of the writing instrument are provided on the inner surface of the cup section (18) for the guidance of the ball (23).

16. A writing instrument in accordance with claim 2 further comprising a tubular writing instrument, wherein grooves (30, 30′, 30″) extending in the longitudinal axis of the writing instrument are provided on the inner surface of the cup section (18) for the guidance of the ball (23).

17. A writing instrument in accordance with claim 3 further comprising a tubular writing instrument, wherein grooves (30, 30′, 30″) extending in the longitudinal axis of the writing instrument are provided on the inner surface of the cup section (18) for the guidance of the ball (23).

18. A writing instrument in accordance with claim 4 further comprising a tubular writing instrument, wherein grooves (30, 30′, 30″) extending in the longitudinal axis of the writing instrument are provided on the inner surface of the cup section (18) for the guidance of the ball (23).

19. A writing instrument in accordance with claim 5 further comprising a tubular writing instrument, wherein grooves (30, 30′, 30″) extending in the longitudinal axis of the writing instrument are provided on the inner surface of the cup section (18) for the guidance of the ball (23).

20. A writing instrument in accordance with claim 6 further comprising a tubular writing instrument, wherein grooves (30, 30′, 30″) extending in the longitudinal axis of the writing instrument are provided on the inner surface of the cup section (18) for the guidance of the ball (23).

* * * * *